United States Patent [19]

Pelfrey

[11] Patent Number: 4,847,974

[45] Date of Patent: Jul. 18, 1989

[54] METHOD FOR FABRICATING A ROLL CRADLE PALLET

[75] Inventor: Steven D. Pelfrey, Warren, Mich.

[73] Assignee: Cadillac Products, Inc., Sterling Heights, Mich.

[21] Appl. No.: 273,414

[22] Filed: Nov. 18, 1988

Related U.S. Application Data

[62] Division of Ser. No. 142,822, Jan. 11, 1988, Pat. No. 4,796,540.

[51] Int. Cl.[4] ..... B21P 17/00

[52] U.S. Cl. ..... 29/421.1; 29/463

[58] Field of Search ..... 29/421 R, 463; 108/52.1, 53.1, 53.3, 55.1, 55.3, 56.1, 56.3, 53.5, 901, 902

[56] References Cited

U.S. PATENT DOCUMENTS 4,371,494 2/1983 Miller ..... 29/463 X 4,756,069 7/1988 Morikawa ..... 29/463

*Primary Examiner*—Timothy V. Eley

*Attorney, Agent, or Firm*—Harness, Dickey & Pierce

[57] ABSTRACT

Disclosed is a roll cradle pallet having an arcuate support portion to support an object. Also disclosed is a method for fabricating a roll cradle pallet.

3 Claims, 3 Drawing Sheets

METHOD FOR FABRICATING A ROLL CRADLE PALLET

This is a division of U.S. Pat. application Ser. No. 142,822 filed Jan. 11, 1988 now U.S. Pat. No. 4,796,540.

BACKGROUND AND SUMMARY OF THE INVENTION

The subject invention relates to a pallet having a two-piece construction for supporting cylindrical objects.

Wooden flat pallets, comprising a flat upper support surface formed by individually spaced wooden strips and legs extending transversely and downwardly from the strips, are probably the most commonly used type of pallet at the present time. One problem with such wooden pallets, however, is that cylindrical objects tend to roll off the flat upper support surface. Wooden blocks may be used as a wedge to keep the cylinderical object from rolling, however, the edges of the wooden block may cut into the cylinderical object if it is a delicate material such as cloth or paper. Also, nails and wood slivers can cause problems. Wooden pallets can break under heavy work or abuse, thus presenting a potential safety hazard.

A primary object of the present invention, therefore, is the provision of an improved pallet which overcomes the aforementioned problems associated with wooden pallets. A related object resides in the provision of an improved method of manufacturing such a pallet.

FIGURES IN THE DRAWINGS

Other advantages of the present invention will be readily appreciated as the same becomes better understood by reference to the following detailed description when considered in connection with the accompanying drawings:

FIG. 8 is a front elevational view of the second member of the subject invention; and FIG. 9 is a top plan view of the second member of the subject invention.

DETAILED DESCRIPTION OF THE DRAWINGS

Figure 3:
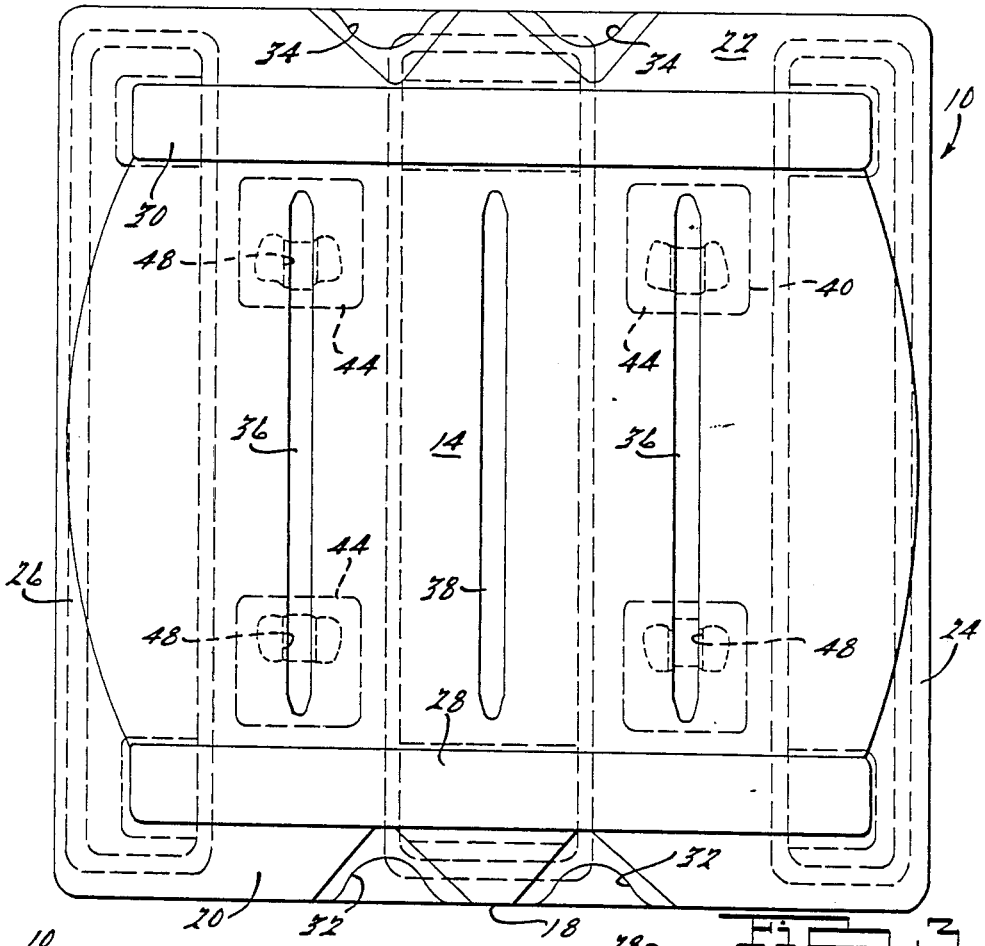
FIG. 3 is a plan view of the pallet of FIG. 1.
Figure 2:
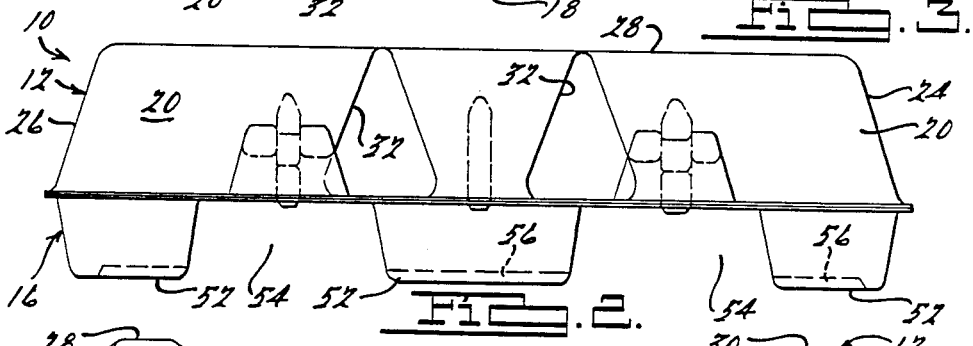
FIG. 2 is a front elevational view of the pallet of FIG. 1.
Figure 1:
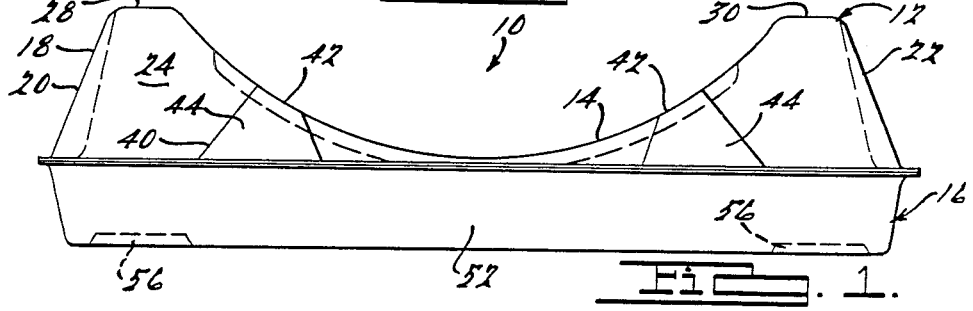
FIG. 1 is a side elevational view of a pallet embodying the principles of the subject invention.

A roll cradle pallet for supporting objects thereupon is generally shown at 10 in FIGS. 1 through 3. The pallet 10 is typically used for supporting an object having at least one curved or arcuate surface, but may be used to support any object configuration. The pallet 10 comprises a first member, generally indicated at 12, having a curved or arcuate support portion 14 to support an object or the curved surface of an object, such as a cylinder or the like. The pallet 10 further comprises a second member, generally indicated at 16, for engaging a support surface to support the first member 12 from the support surface. The first member 12 is supported upon the second member 16 and sealed around the flanges or border between the two by welding or the like to form an integrated or one-piece pallet 10.

Figure 6:
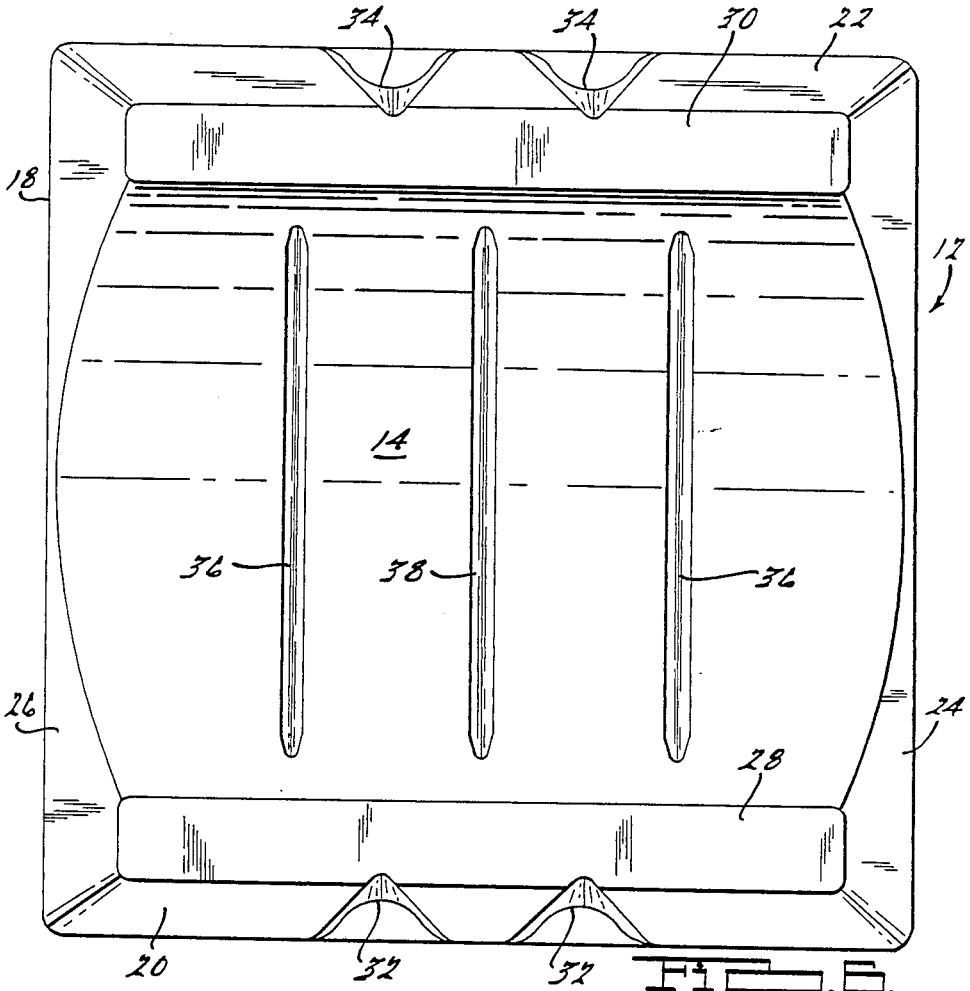
FIG. 6 is a top plan view of the first member of the subject invention.
Figure 5:
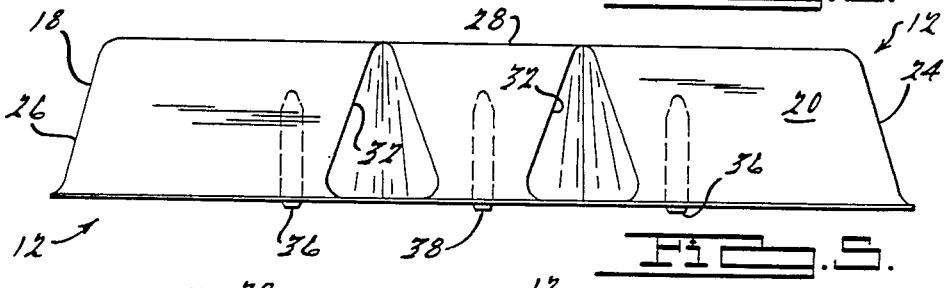
FIG. 5 is a front elevational view of the first member of the subject invention.
Figure 4:
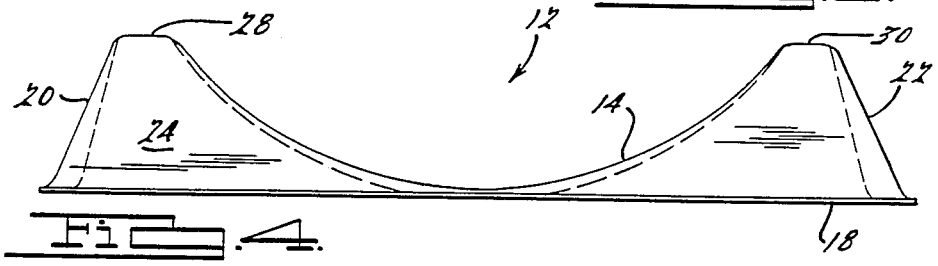
FIG. 4 is a side elevational view of the first member of the subject invention.
Figure 6:
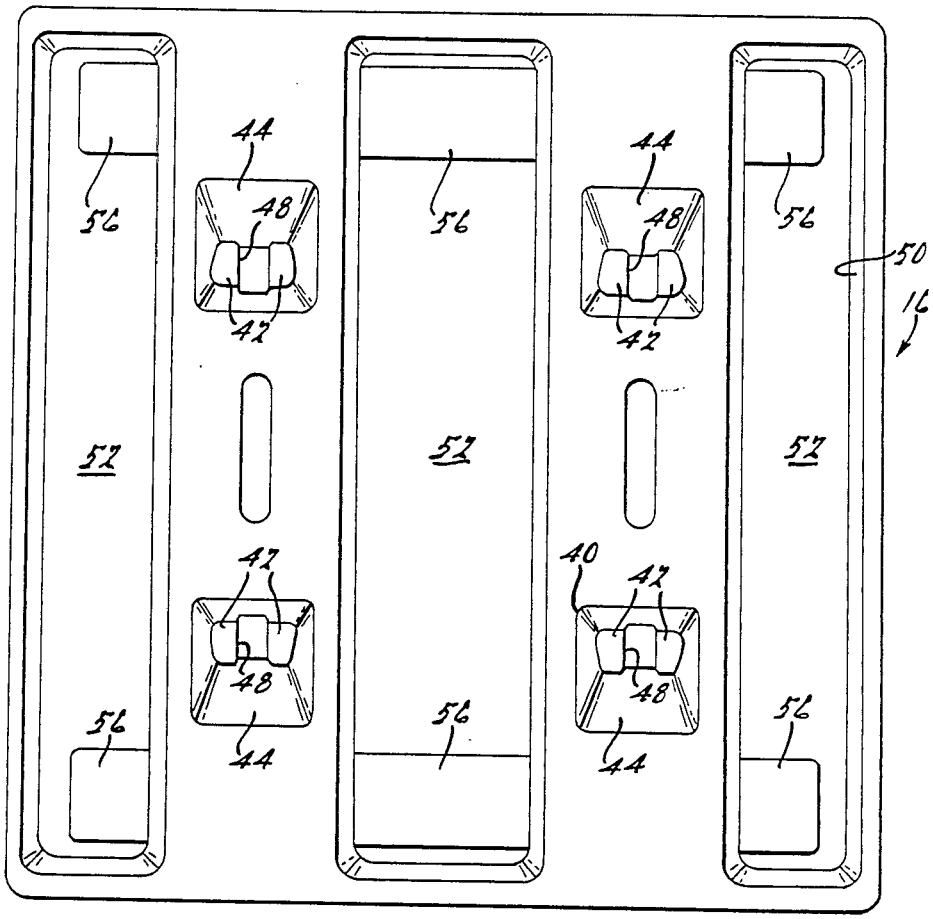
Figure 5:
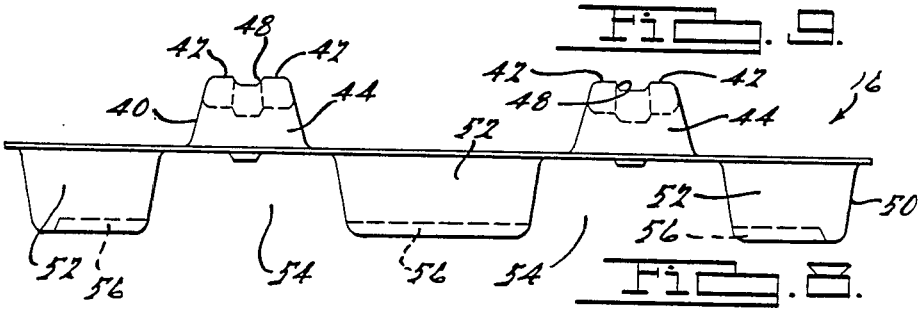
Figure 7:
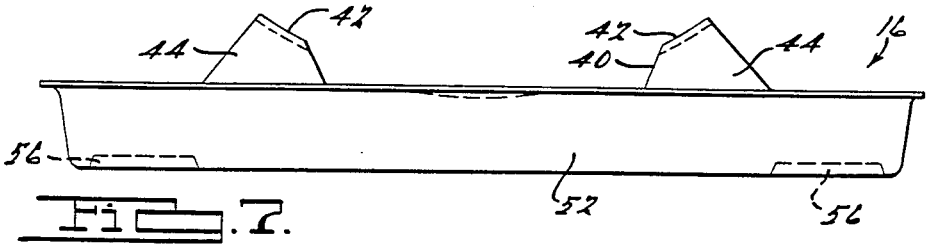
FIG. 7 is a side elevational view of the second member of the subject invention.

As illustrated in FIGS. 4 through 6, the first member 12 includes side wall means 18 for supporting the arcuate support portion 14 at the axial and circumferential ends thereof upon the second member 16. The side wall means 18 comprises side walls 20 and 22 spaced and substantially parallel one from the other at the circumferential ends of the arcuate support portion 14. The side wall means 18 further comprises end walls 24 and 26 axially spaced and substantially parallel one from the other at the axial ends of the arcuate support portion 14. One end of the side walls 20 and 22 are connected to an adjacent end of the end walls 24, 26 to form an integrated rectangular support frame for the axial and circumferential ends of the arcuate support portion 14. The side walls 20 and 22 also include a male portion 28 and 30, respectively, extending outwardly from one end of the side walls 20, 22 along the length thereof. The male portions 28, 30 are rectangularly configured and lie in the same plane above the circumferential ends of the arcuate support portion 14. The side walls 20 and 22 include at least one, and preferably a plurality of, recessed portions 32 and 34, respectively, extending inwardly therefrom to strengthen the side walls 20 and 22. The recessed portions 32, 34 are similar to ribs having a triangular configuration for strengthening the side walls 20, 22.

The arcuate support portion 14 of the first member 12 further includes at least one, and preferably a plurality of, first ribs 36 as depressions extending radially outward and circumferentially along the arcuate support portion 14 to be received or engaged by the second member 16. The arcuate support portion 14 also includes one second rib 38 disposed between a pair of first ribs 36 and extending radially outward and circumferentially along the arcuate support portion 14 to strengthen the arcuate support portion 14. The ribs 36 and 38 are semi-cylindrical or partially arcuate in cross-section and are similar to raised ribs extending radially outward from the arcuate support portion 14 toward the second member 16.

The second member 16 includes protrusion means 40 extending outwardly therefrom for engaging and supporting the arcuate support portion 14 of the first member 12. The protrusion means 40 includes a curved or arcuate surface 42 at the free end thereof configured complementary to the arcuate support portion 14 to nest and support the arcuate support portion 14 of the first member 12 upon the protrusion means 40 to form an integrated pallet 10. The protrusion means 40 comprises at least one, and preferably a plurality of, protrusion members 44 extending outwardly from the second member 16 similar to a post and spaced laterally and longitudinally from each other to engage the arcuate support portion 14 at various locations along the surface thereof. The curved surface 42 is located at the free end of the protrusion member 44. The curved surface 42 of the protrusion member 44 also includes at least one slot 48 formed or recessed in the curved surface 42 of the protrusion member 44. The slot 48 has a configuration complementary to the first rib 36 for receiving the first rib 36 and to operate as a locating means for locating the first member 12 upon the second member 16.

The second member 16 also includes leg means 50 extending outwardly in a direction opposite to the protrusion members 44 for engaging a support surface to support the pallet 10 upon the support surface. The leg means 50 includes at least one, and preferably a plurality of laterally or axially spaced leg members 52 extending outwardly from the second member 16 in a direction opposite to the protrusion members 44. The leg members 52 are laterally spaced one from the other to define at least one, preferably a plurality of, channels 54 between a pair of leg members 52 to permit the entry of a lifting device such as a fork of a fork lift to raise and lower the second member 16 from the support surface. The leg members 52 include a female portion 56 recessed in the leg members 52 across the lateral width thereof and complementary to the male portion 28, 30 for receiving the male portion 28, 30 of the side walls 20, 22, respectively. The female portion 56 of the leg members 52 and the male portion 28, 30 of the side walls 20, 22 operate as a stacking means for stacking the second member 16 of a first pallet upon the first member 12 of a second pallet. Hence, the stacking means 28, 30, 56 allows the second member 16 to be stacked upon the first member 12.

Reinforcement of the leg members 52 relative to first member 12 would allow the pallet to be used in applications requiring the support of objects having a weight which could tend to crush the pallet. Such reinforcement could be provided by stiffening ribs being integrally formed in the vertical side walls defining the leg members 52. Further, separate reinforcing members could be disposed in the interior cavity formed by the leg member. In accord with this invention support beams (e.g., wooden 2″×4″'s) substantially coextensive with the leg member could be placed interiorly of the cavity formed by the leg member.

Recessed portions 32 and 34 could be trapezoidal in shape whereby the inward ribs so formed by the portions provide a handle for the user to grip the pallet for lifting.

Both the first member 12 and second member 16 are made of a polymer material such as high density polyethylene (HDPE) or the like and are fabricated by vacuum forming utilizing conventional techniques.

Accordingly, the roll-cradle pallet 10 is a cost reduction over wooden pallets and the use of a polymer material which may be easily vacuum formed. It also eliminates sharp objects, such as spliners and the like, could damage the cylindrical objects being supported. Further, the cradle eliminates the use of braces, stops or supports as well as strapping merely to secure the cylindrical objects on the pallet. Finally, the roll-cradle pallet is stackable for easy storage.

The subject invention has been described in an illustrative manner. It is to be understood that the terminology which has been used is intended to be in the nature of words of description rather than of limitation.

Obviously, many modifications and variations of the subject invention are possible in light of the above teachings. Therefore, the subject invention may be practiced otherwise than as specifically described.

What is claimed is:

1. A method of making a roll cradle pallet for supporting an object, said method comprising the steps of:

vacuum forming a first member with an arcuate support portion to support an object;

vacuum forming a second member having at least one protrusion member extending outwardly from the second member with a curved surface complementary circumferentially to the arcuate support portion;

nesting and supporting the arcuate support portion upon the curved surface of the protrusion member; and welding the members together whereby to form an integrated pallet.

2. A method as recited in claim 1, wherein said vacuum forming of the second member provides a leg member having a cavity, and including the step of disposing a separate reinforcing element into said cavity prior to welding the members together.

3. A method as recited in claim 1, wherein the step of vacuum forming of said first and second members forms an outer periphery around each respective member, each periphery, respectively, enclosing said support portion and said protrusion, and the step of welding causes one and the other periphery of said members to be welded together.

* * * * *